US008287107B2

(12) United States Patent
Terada

(10) Patent No.: US 8,287,107 B2
(45) Date of Patent: Oct. 16, 2012

(54) INK PASSAGES, PLATENS FOR AN INKJET RECORDING DEVICE, AND INKJET RECORDING DEVICES

(75) Inventor: Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 670 days.

(21) Appl. No.: 12/242,522

(22) Filed: Sep. 30, 2008

(65) Prior Publication Data

US 2009/0109265 A1 Apr. 30, 2009

(30) Foreign Application Priority Data

Oct. 30, 2007 (JP) ..... 2007-282132

(51) Int. Cl.
*B41J 2/175* (2006.01)
*B41J 2/01* (2006.01)

(52) U.S. Cl. ..... 347/85; 347/105

(58) Field of Classification Search ..... None
See application file for complete search history.

(56) References Cited

U.S. PATENT DOCUMENTS 5,181,433 A 1/1993 Ueno et al.
6,531,206 B2 3/2003 Johnston et al.
7,703,869 B2 * 4/2010 Ota ..... 347/8
2003/0210307 A1 * 11/2003 Ito et al. ..... 347/71
2006/0023052 A1 2/2006 Watanabe et al.
2006/0170749 A1 8/2006 Watanabe
2006/0268087 A1 11/2006 Sasa
2007/0146463 A1 6/2007 Sasa

FOREIGN PATENT DOCUMENTS

JP H11-083371 A 3/1999
JP 2006-035685 A 2/2006
JP 2006-205693 A 8/2006
JP 2006-205697 A 8/2006
JP 2007-175971 A 7/2007

OTHER PUBLICATIONS

Japan Patent Office, Notice of Reasons for Rejection for Japanese Patent Application No. 2007-282132 (counterpart to above-captioned patent application), mailed Aug. 2, 2011.
Japan Patent Office, Decision to Grant a Patent for Japanese Patent Application No. 2007-282132 (counterpart to above-captioned patent application), mailed Nov. 29, 2011.

* cited by examiner

*Primary Examiner* — Matthew Luu
*Assistant Examiner* — Erica Lin
(74) *Attorney, Agent, or Firm* — Baker Botts L.L.P.

(57) ABSTRACT

According to an embodiment of the present invention, an ink passage comprises an ink passage comprising a first surface; and a second surface; wherein ink flows in an ink flow direction from the first surface to the second surface, and wherein a downstream edge of the first surface and an upstream edge of the second surface intersect each other.

13 Claims, 9 Drawing Sheets

INK PASSAGES, PLATENS FOR AN INKJET RECORDING DEVICE, AND INKJET RECORDING DEVICES

CROSS REFERENCE TO RELATED APPLICATIONS

The present application claims priority from Japanese Patent Application No. 2007-282132, which was filed on Oct. 30, 2007, the disclosure of which is incorporated herein by reference in its entirety.

BACKGROUND OF THE INVENTION

1. Field of the Invention

The present invention relates generally to an ink passage having a first surface and a second surface which are adjacent to each other in an ink flow direction. In particular, the present invention is directed toward a platen for an inkjet recording device and an inkjet recording device in which ink droplets selectively ejected from a recording head smoothly are guided from the first surface to the second surface.

2. Description of Related Art

A known inkjet image recording device records an image on a recording sheet, e.g., a recording medium, by ejecting ink onto the recording sheet. The known inkjet recording device includes an inkjet recording head, and selectively ejects ink droplets from nozzles of the recording head. The ink droplet reaches the recording sheet, and a desired image is recorded on the recording sheet. In the known inkjet recording device, a plurality of recording sheets are stored in a feed cassette or a feed tray, and when printing is to be performed, a recording sheet is fed to a position directly below the recording head. A platen for an inkjet recording device is positioned directly below the recording head to support the recording sheet, such that the recording sheet faces the recording head.

As the accuracy of printing increases, a size of an ink droplet to be ejected from the recording head decreases, which may cause a small ink droplet that has not reached the recording sheet to float above the recording sheet. This floating ink droplet may be known as an ink mist. The ink mist may adhere to peripheral members of the recording head, such as the platen. Some of ink droplets ejected from the recording head may not reach the recording sheet, but may reach the platen, which is especially noticeable when printing is performed without a margin provided at an edge of the recording sheet. When the ink droplets adhere to the platen, the adhered ink droplets may be transferred to a subsequently fed recording sheet, and thus, the subsequent recording sheet may be contaminated, or an image formed on the subsequent recording sheet may be deteriorated, or both.

In another known inkjet image recording device, such as the inkjet image recording device described in Japanese Unexamined Patent Application Publication No. 2007-175971, an ink passage, such as a groove, is formed in an upper surface and a sidewall of a platen, and ink adhering to the upper surface of the platen is guided to a back surface of the platen by the ink passage. Because ink is removed from the upper surface of the platen, the ink may be prevented from adhering to the subsequently fed recording sheet. The ink guided to the back surface of the platen is further guided to an ink absorber, and is absorbed thereby.

A known platen may have a flat-plate shape and may include a synthetic resin, such as polystyrene or ABS. The known platen may be formed using by injection molding. A synthetic resin molded product is made by molding synthetic resin in a mold. For example, in two-plate molding, a mold is divided into two fixed and movable molds, and these molds are clamped with a predetermined amount of pressure to form a cavity. Heated and melted synthetic resin is injected into the cavity to make a synthetic resin molded product, the molded product is cooled, then the two molds are opened, and the synthetic resin molded product is removed. A mating surface of the two molds is known as a parting surface. A step-like mark is left on the synthetic resin molded product at an edge of the parting surface due to a minute displacement of the two molds from each other. For example, when a flat-plate platen is made by injection molding using a two-plate mold, a step-like mark generally is left at a side wall of the flat-plate platen. If a step-like mark is generated across the above-described ink passage, the flow of ink is interrupted by the step-like mark, and the ink accumulates at the edge of the parting surface.

For example, as shown in FIG. 9A, when a step-like mark 102 is formed substantially at a center portion of a side wall 101 of a platen 100, such that an upper side wall 104 horizontally protrudes beyond a lower side wall 105, the contact angle with respect to the side wall 101 of the ink droplet 103, which moves downward along the upper side wall 104 by a gravitational force, changes at the step-like mark 102, and a surface tension acting on the ink droplet 103, which acts to move the ink droplet 103 back to the upper side, increases. As a result, the ink droplet 103 remains at the step-like mark 102. Thus, in order to move the ink droplet 103 beyond the step-like mark 102 toward the lower side wall 105, an amount of drive force applied to the ink droplet 103 may need to be increased.

Similarly, as shown in FIG. 9B, when a step-like mark 102 is formed substantially at the center portion of the side wall 101 of the platen 100, such that the lower side wall 105 horizontally protrudes beyond the upper side wall 104, the ink droplet 103, which moves downward along the wall surface of the upper side wall 104 by a gravitational force, is supported by and remains on a horizontal surface of the step-like mark 102. When the size of the ink droplet 103 increases, the ink droplet attempts to move to the lower side wall 105 from the horizontal surface. At this time, the contact angle of the ink droplet 103 with respect to the side wall 101 changes, and the surface tension acting on the ink droplet 103, which acts to move the ink droplet 103 back to the horizontal surface, increases. As a result, the ink droplet 103 remains at the step-like mark 102. Thus, in order to move the ink droplet 103 beyond the step-like mark 102 toward the lower side wall 105, an amount of drive force applied to the ink droplet 103 may need to be increased.

As described above, when the ink accumulates at the step-like mark 102 on the side wall 101 of the platen 100, the flow of the ink from a front surface to a back surface of the platen 100 may be interrupted, and consequently, a recording sheet may be contaminated, or an image formed on the recording media may be deteriorated, or both.

SUMMARY OF THE INVENTION

Therefore a need has arisen for ink passages, platens and inkjet recording devices which overcome these and other shortcomings of the related art. A technical advantage of the present invention is that a recording sheet may not be contaminated and an image formed on the recording sheet may not be deteriorated from ink adhering to the platen.

According to an embodiment of the present invention, an ink passage comprises an ink passage comprising a first surface; and a second surface; wherein ink flows in an ink flow direction from the first surface to the second surface, and wherein a downstream edge of the first surface and an upstream edge of the second surface intersect each other.

According to another embodiment of the present invention, a platen comprises a front surface configured to support thereon a recording medium; and a plurality of ink passages each comprising a first surface; and a second surface; wherein ink flows in an ink flow direction from the first surface to the second surface, and wherein a downstream edge of the first surface and an upstream edge of the second surface intersect each other.

According to yet another embodiment of the present invention, an inkjet recording device comprises a recording head configured to eject ink; and a platen comprising a front surface configured to support thereon a recording medium; and a plurality of ink passages each comprising a first surface; and second surface; wherein ink flows in an ink flow direction from the first surface to the second surface, and wherein a downstream edge of the first surface and an upstream edge of the second surface intersect each other.

Other advantages of the present invention will be apparent to persons of ordinary skill in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF EMBODIMENTS

Embodiments of the present invention may be understood by referring to FIGS. 1-8, like numerals being used for like corresponding parts in the various drawings.

Figure 1:
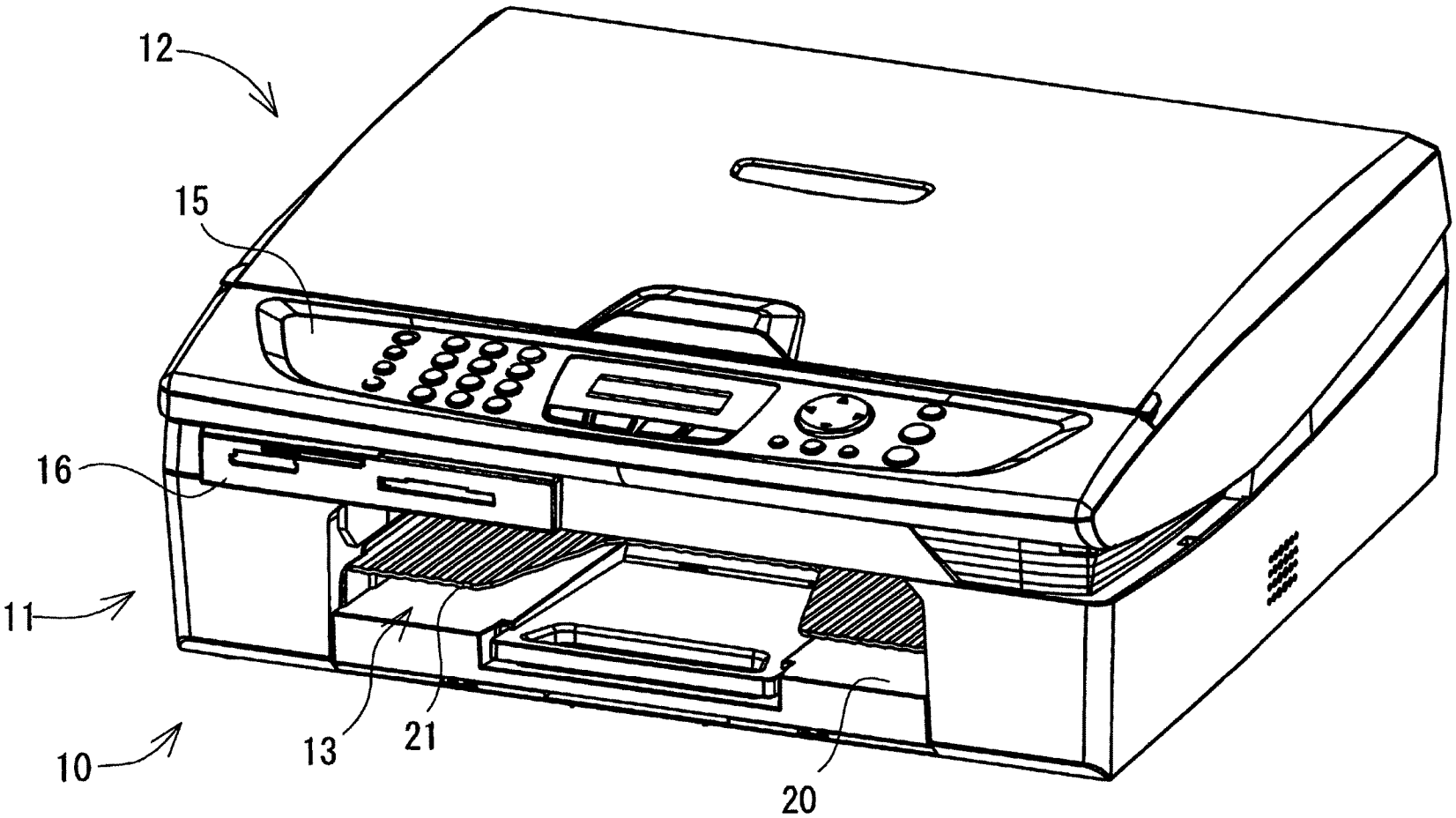
FIG. 1 is an external, perspective view of a multi-function device, according to an embodiment of the present invention.

Referring to FIG. 1, a multi-function device 10 may comprise a printer 11 and a scanner 12, and may be configured to perform a print function, a scan function, a copy function, or a facsimile function, or any combination thereof. The printer 11 may be an inkjet recording device, according an embodiment of to the present invention.

The printer 11 may be connected to an external information device, such as a computer or a digital camera. The printer 11 may be configured to record an image e.g., text, on a recording sheet, e.g., a recording medium, in accordance with print data transmitted from the external information device. A storage medium, such as a memory card, may be inserted into the multi-function device 10. The printer 11 may record an image on a recording sheet in accordance with print data stored in the storage medium.

The multifunction device 10 may be a substantially rectangular parallelepiped, and may have a larger width and depth than a height. A lower portion of the multi-function device 10 may be the printer 11. The multi-function device 10 may have an opening 13 formed in a front surface thereof. A feed tray 20 and a discharge tray 21 may be positioned vertically in the opening 13 at two stages.

An upper portion of the multi-function device 10 may be a scanner 12. The scanner 12 may be a flatbed scanner.

An operation panel 15 may be positioned at an upper portion of the front surface of the multi-function device 10. A user may use the operation panel 15 to operate the printer 11 and the scanner 12, and may comprise a plurality of operation buttons and a liquid crystal display. The multi-function device 10 may be operated in accordance with an operation instruction from the operation panel 15. When the multifunction device 10 is connected to the external information device, the multi-function device 10 also may be operated in accordance with an instruction transmitted from the external information device through a printer driver or a scanner driver. In addition, a slot unit 16 may be positioned at an upper left portion of the front surface of the multifunction device 10. The memory card may be inserted to the slot unit 16, and data in the memory card may be read or data may be written in the memory card.

Figure 2:
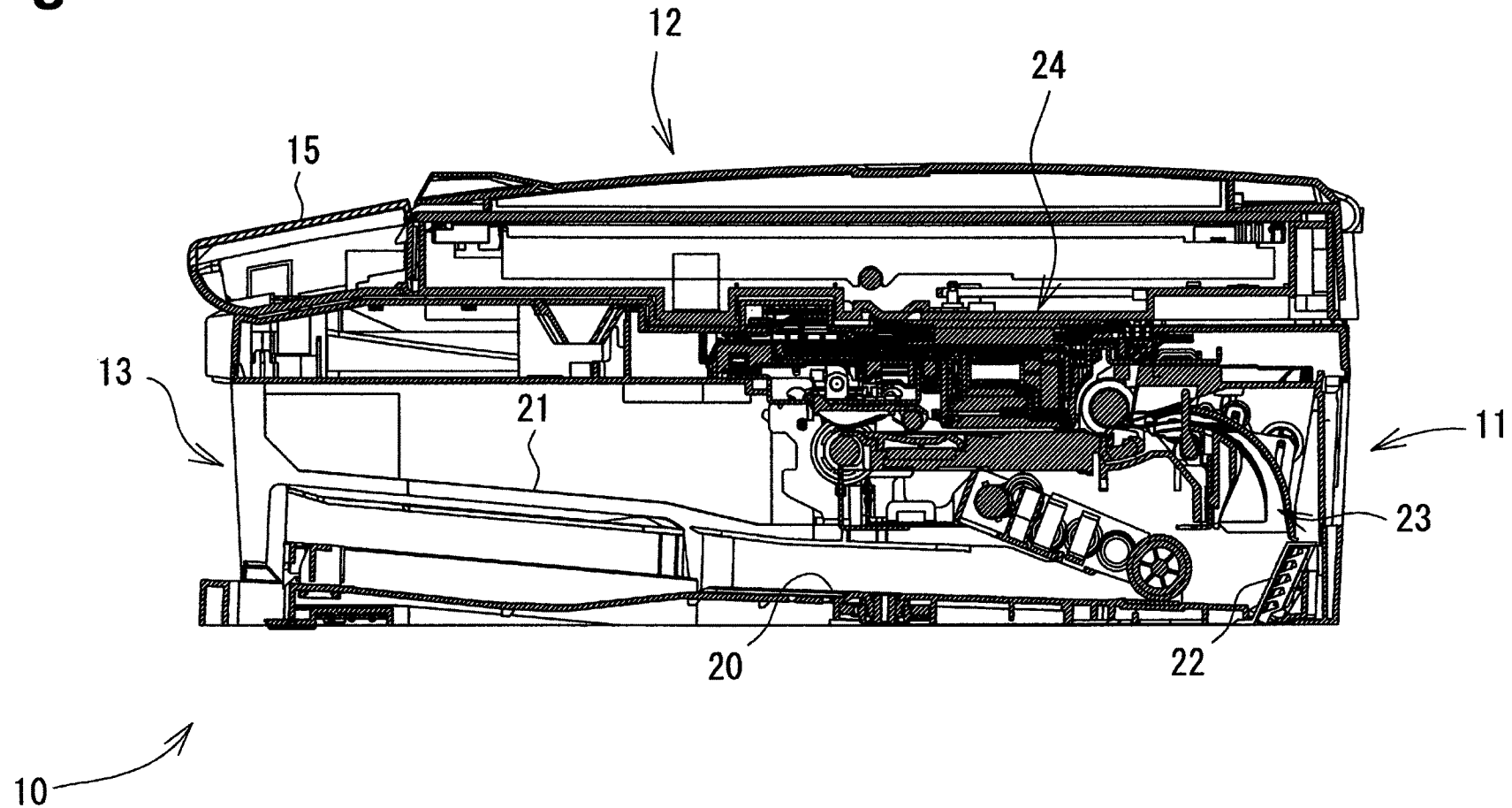
FIG. 2 is a vertical, cross-sectional view of the multi-function device of FIG. 1.

Referring to FIG. 2, the feed tray 20 may be positioned adjacent to a bottom of the multi-function device 10. The feed tray 20 may hold recording sheets of various sizes, including A4 size or sizes which are smaller than A4 size.

Figure 3:
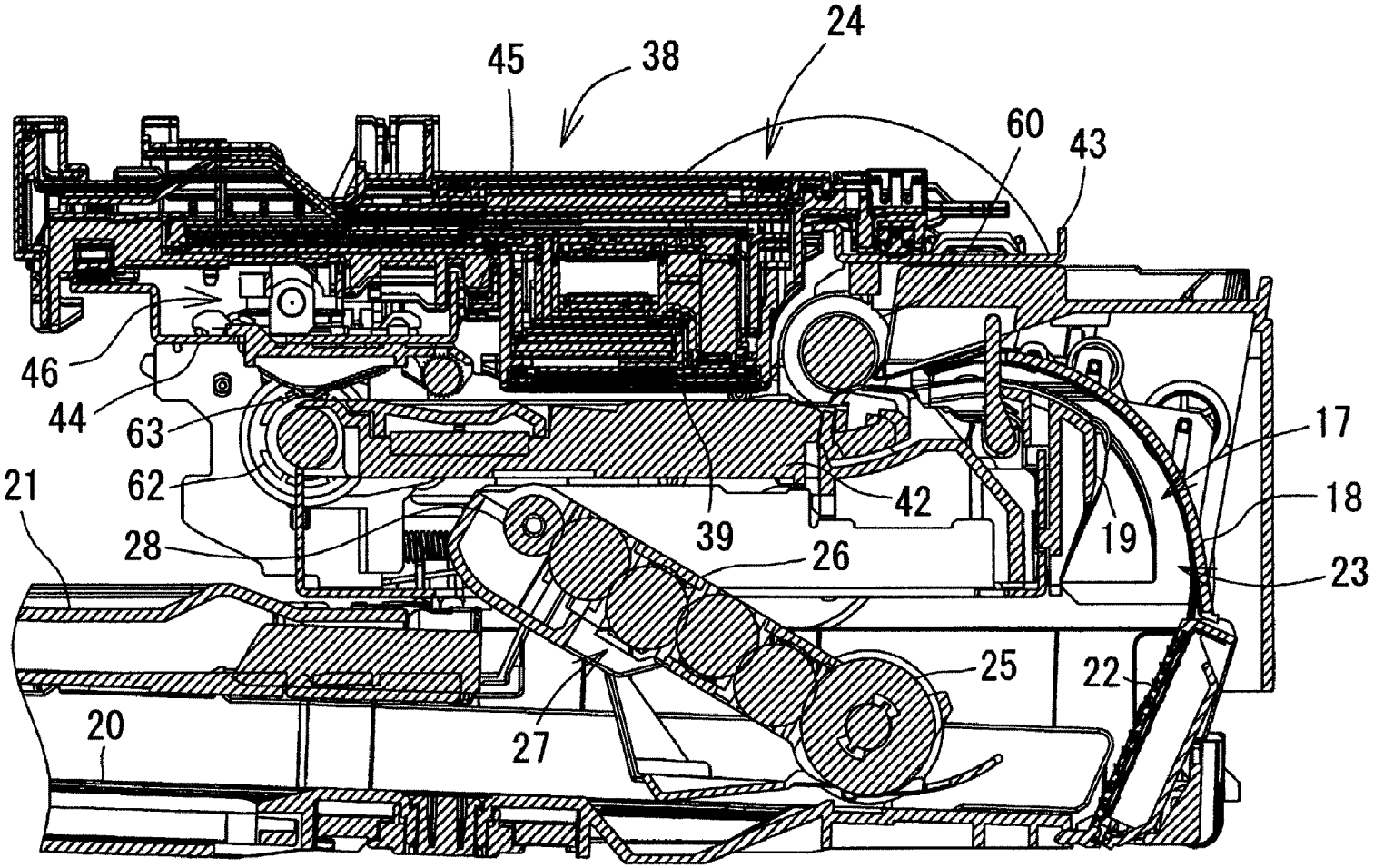
FIG. 3 is an enlarged, fragmental, cross-sectional view of a printer, according to an embodiment of the present invention.

Referring to FIG. 3, a feed roller 25 may be positioned above the feed tray 20. The feed roller 25 may feed recording sheets positioned on the feed tray 20 to the sheet conveying path 23. The feed roller 25 may be supported at a tip end of an arm 26. The feed roller 25 is rotationally driven by a motor (not shown) via a drive force transmission mechanism 27 provided along the arm 26. The drive force transmission mechanism 27 may comprise a plurality of gears which mesh with each other.

The arm 26 may be supported by a shaft 28 at a base end of the arm 26, and may be pivotable around the shaft 28. With pivot of the arm 26, the feed roller 25 may be vertically moved relative to the feed tray 20 to selectively be in contact with and separated from the feed tray 20. The arm 26 may be pivoted downward by a weight of the arm 26 or a biasing force of a spring or the like. When the arm 26 is pivoted downward, the feed roller 25 may apply a force to the recording sheets on the feed tray 20. When the feed roller 25 is rotated in this state, the uppermost recording sheet may be fed to a separation plate 22 positioned in a deep portion of the feed tray 20.

The sheet conveying path 23 may extend from the upper side of the separation plate 22 upward and make U-turn to a discharge tray 21 arranged above the fed tray 20. An arcuate portion 17 of the sheet conveying path 23 may be defined by an outer guide member 18 and an inner guide member 19 which face each other and are fixed to a device frame. A recording sheet may be conveyed from the feed tray 20 toward a print unit 24, and the recording sheet with a desired image recorded thereon may be discharged to the discharge tray 21.

The print unit 24 may be arranged downstream of the arcuate portion 17 in a sheet conveying direction in the sheet conveying path 23. The print unit 24 may comprise a carriage 38 and an inkjet recording head 39. The recording head 39 may be mounted on the carriage 38. The carriage 38 may be reciprocated in a horizontal direction orthogonal to the sheet conveying direction. Though not shown in FIG. 3, ink cartridges may be arranged in the multi-function device 10 separately from the recording head 39. The recording head 39 may be supplied with color inks of cyan (C), magenta (M), yellow (Y), and black (Bk) from the ink cartridges through ink tubes.

Though not shown, the recording head 39 may comprise a plurality of nozzles in a lower surface thereof. The nozzles may be arranged in a line in the sheet conveying direction, e.g., a left-right direction in FIG. 3, for each of the color inks of C, M, Y, and Bk. A piezoelectric element provided in each nozzle may vibrate and an ink droplet of a color ink may be ejected from each nozzle. While the carriage 38 is reciprocated, the color inks may be selectively ejected from the recording head 39 as relatively small ink droplets. Accordingly, an image may be recorded on a recording sheet being conveyed onto a platen 42.

A pair of guide rails 43 and 44 may be arranged above the sheet conveying path 23, separated from each other by a predetermined distance in the sheet conveying direction.

The carriage 38 may be arranged to bridge over the guide rails 43 and 44, and may be slidable in the longitudinal direction of the guide rails 43 and 44, e.g., in the direction orthogonal to the sheet conveying direction. The carriage 38 may be reciprocated on the guide rails 43 and 44 by a belt drive mechanism 46 disposed on an upper surface of the guide rail 44.

The platen 42 may be positioned below the guide rails 43 and 44 and may face the recording bead 39 and may overlap a center portion of the carriage reciprocating range, where a recording sheet passes. The platen 42 may have a width sufficiently larger than a maximum width of a recording sheet to be conveyed by the printer 11. Thus, both edges in a width direction of the recording sheet to be conveyed pass over the platen 42.

A conveying mechanism for conveying a recording sheet may comprise a convey roller 60, a pinch roller, a discharge roller 62, a spur roller 63, and the feed roller 25.

The convey roller 60 and the pinch roller may be positioned upstream of the print unit 24 in the sheet conveying direction. The convey roller 60 and the pinch roller may convey a recording sheet conveyed through the sheet conveying path 23 onto the platen 42.

The discharge roller 62 and the spur roller 63 may be positioned downstream of the print unit 24 in the sheet conveying direction. The discharge roller 62 and the spur roller 63 may convey a recording sheet with an image recorded thereon to the discharge tray 21. The convey roller 60 and the discharge roller 62 may be rotated synchronously and intermittently, such that a recording sheet may be intermittently conveyed by a predetermined linefeed width.

Figure 4:
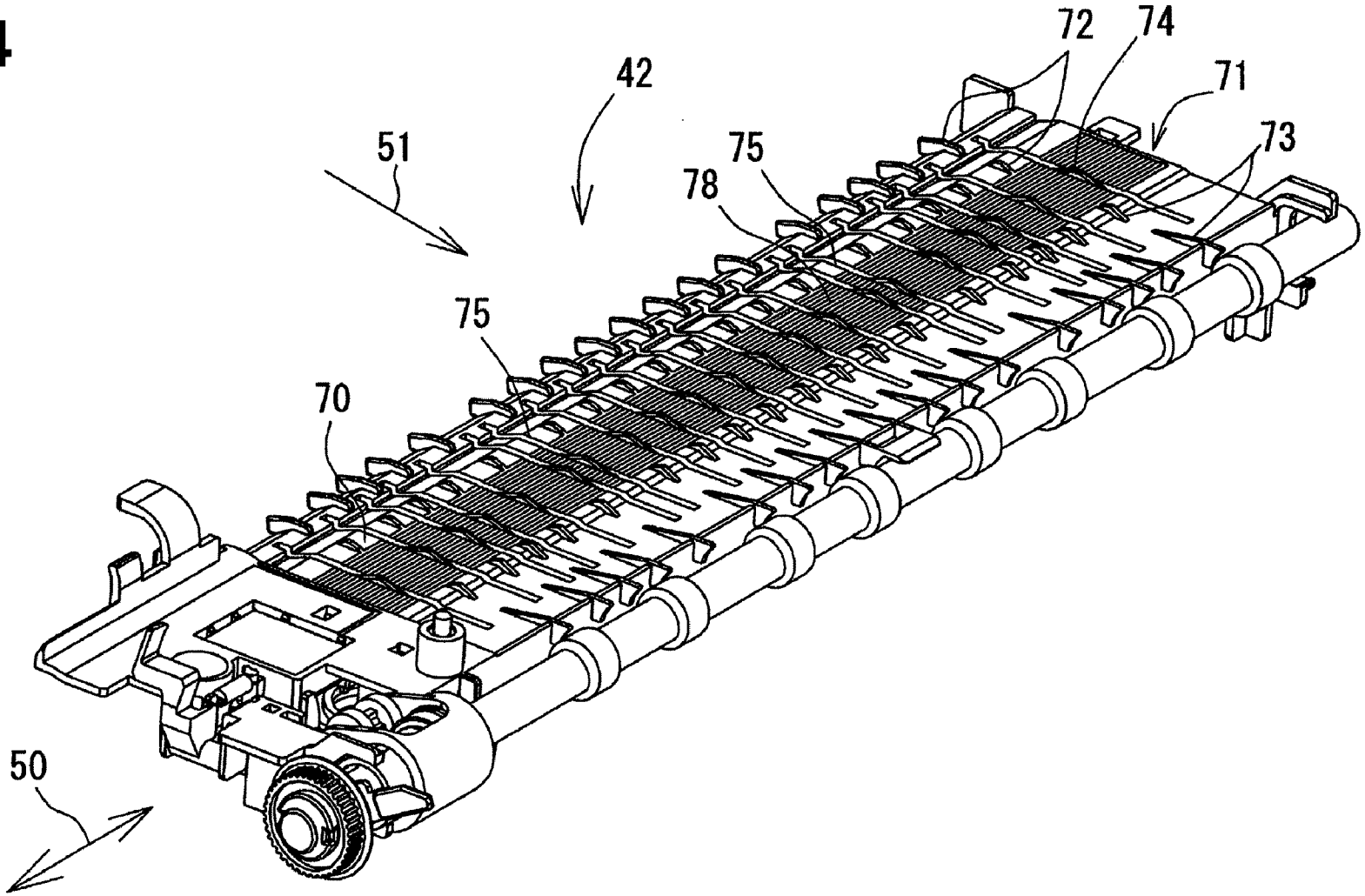
FIG. 4 is an enlarged, perspective view of a platen, according to an embodiment of the present invention.

Referring to FIG. 4, the platen 42 may have a substantially flat-plate shape, and may be arranged, such that a front surface 70 thereof faces a lower surface of the recording head 39. A longitudinal direction of the platen 42 may be parallel to a sheet width direction, e.g., the direction indicated by arrow 50. In FIG. 4, the sheet conveying direction is indicated by arrow 51.

Figure 5:
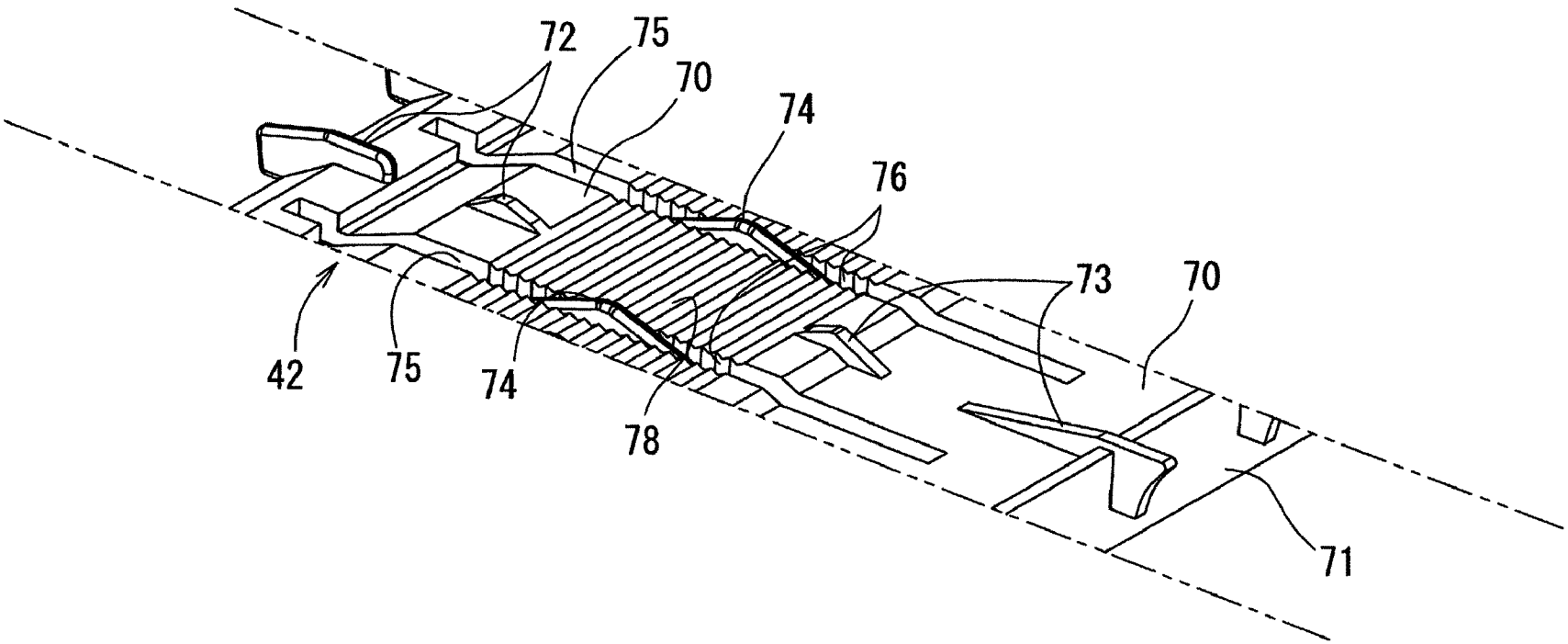
FIG. 5 is an enlarged, fragmental, perspective view of the platen of FIG. 4.

Referring to FIGS. 4 and 5, the platen 42 may comprise a frame 71, ribs 72 and 73 positioned at the frame 71, and movable ribs 74 slidably positioned at the frame 71. The frame 71 may be a molded product comprising a synthetic resin by injection molding. The frame 71 may have a substantially C-shaped cross section and may open downward. A drive mechanism for driving the movable ribs 74 may be positioned within the frame 71.

The ribs 72 and 73 may be positioned at the front surface 70 of the frame 71. The front surface 70 may face the recording head 39. The ribs 72 may be arranged at a predetermined interval in a longitudinal direction of the platen 42, adjacent to an upstream edge of the front surface 70 in the sheet conveying direction. The ribs 72 may protrude upward toward the recording head 39. The ribs 73 may be arranged at predetermined intervals in the longitudinal direction 50 of the platen 42 adjacent to a downstream edge of the front surface 70 in the sheet conveying direction. The ribs 73 may protrude upward toward the recording head 39.

A plurality of slits 75 may be formed in the front surface 70 of the frame 71, and may extend in the sheet conveying direction. The slits 75 may be arranged at a predetermined interval in the longitudinal direction of the platen 42. The slits 75 may extend in the sheet conveying direction. The movable ribs 74 may protrude upward from the front surface 70 toward the recording head 39 through the slits 75. The movable ribs 74 may be configured to slide in the sheet conveying direction within the slits 75.

A recording sheet conveyed onto the platen 42 may be supported by the ribs 72 and 73 and the movable ribs 74 to face the recording head 39. The ribs 72 and 73 and the movable ribs 74 may have substantially the same protruding heights. The recording sheet may be supported, such that a recording surface thereof is parallel to the lower surface of the recording head 39 in a lifted manner from the front surface 70.

Referring to FIGS. 5-8, ink passages 80 may be provided in the platen 42 from the front surface 70 to a back surface 77 via side walls 76. The ink passages 80 may be defined by a surface groove 78, a first groove 81, a second surface 48, and a second groove 82. The first groove 81 may be defined by a first surface 83 and a third surface 85. In the ink passage 80, a gravitational force and/or a capillary force may be a drive force for ink to flow. The ink that has received the drive force may be guided from the front surface 70 to the back surface 77 of the platen 42 via the ink passage 80.

Referring to FIG. 5, the surface grooves 78 may be formed in the front surface 70 of the platen 42. The surface grooves 78 may extend between adjacent two slits 75 and may have a substantially V-shaped vertical cross section. The surface groove 78 may be recessed from the front surface 70 toward the back surface 77 (see FIG. 7), and may extend in the direction orthogonal to the sheet conveying direction. The surface grooves 78 may be arranged side by side in the sheet conveying direction. Both ends of the surface grooves 78 may be open toward the corresponding slits 75, and define the first grooves 81.

Figure 6:
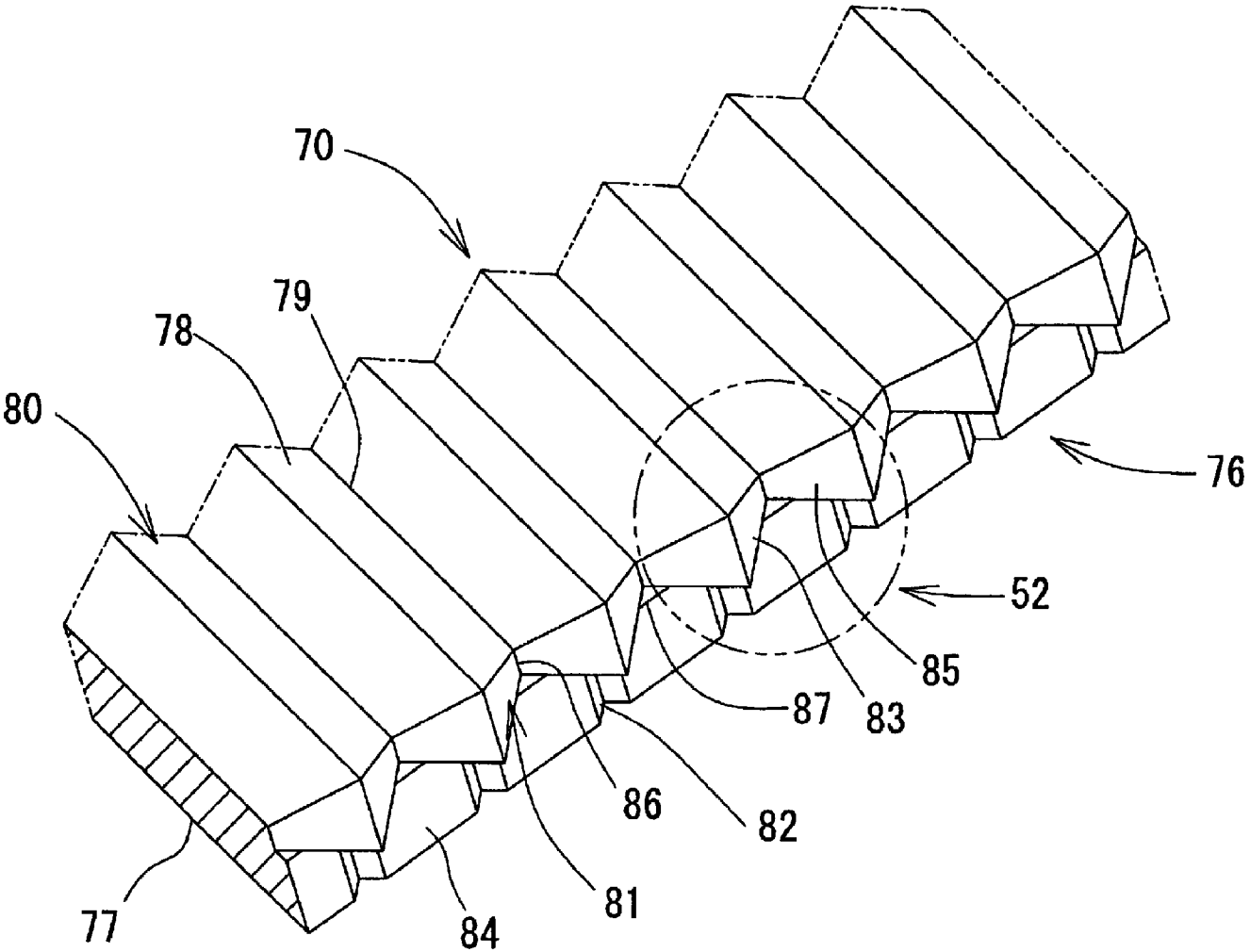
FIG. 6 is a perspective view of a portion of the platen of FIG. 4, as viewed from a front surface thereof.
Figure 7:
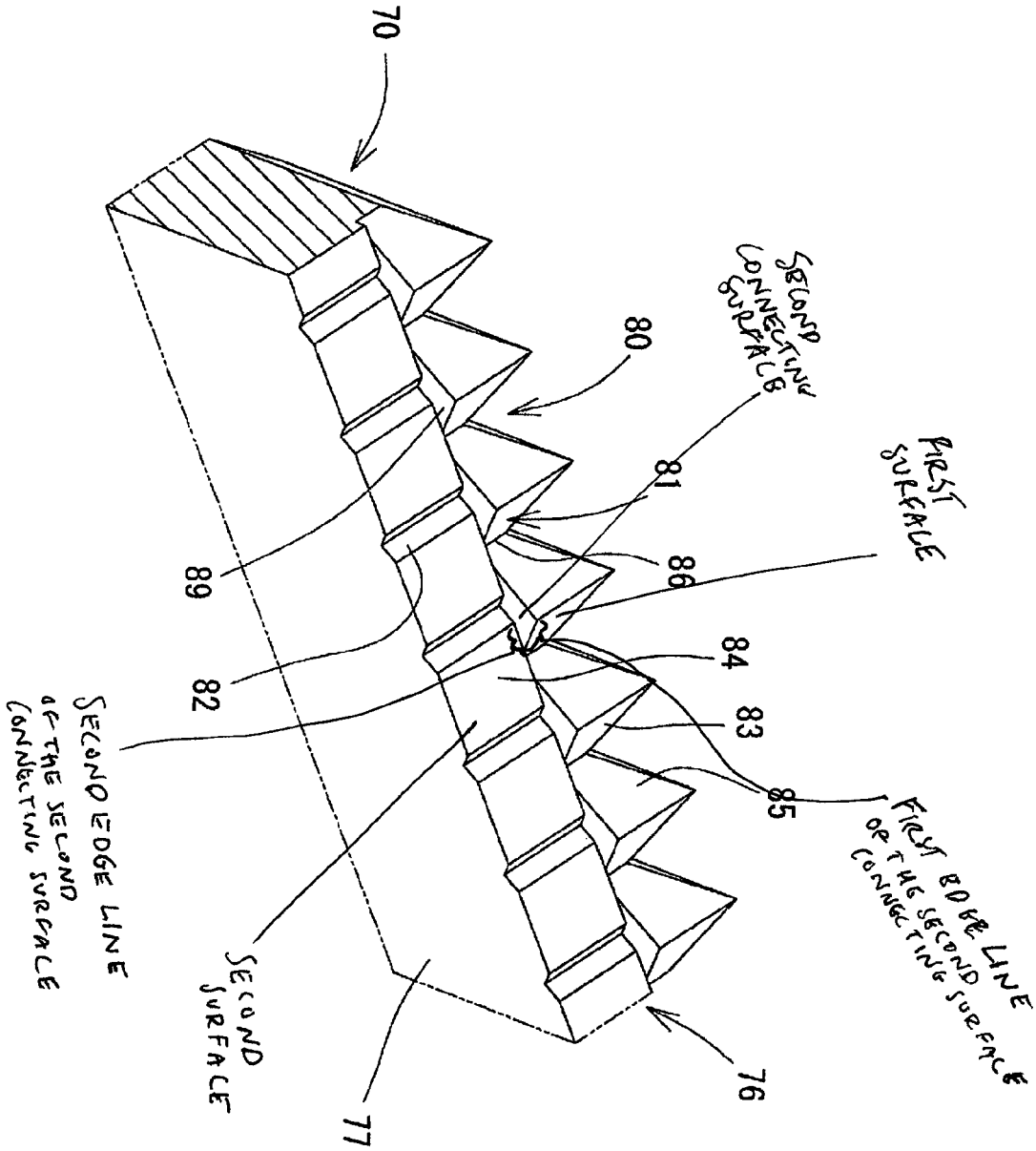
FIG. 7 is a perspective view of a portion of the platen of FIG. 4, as viewed from a back surface thereof.

Two side walls 76 may face each other in the direction orthogonal to the sheet conveying direction, with the slit 75 interposed therebetween. The side walls 76 may extend from the front surface 70 to the back surface 77, and may be orthogonal to the front surface 70 and the back surface 77. Referring to FIGS. 6 and 7, the first grooves 81 may be formed in the side wall 76 adjacent to the front surface 70, and the second surfaces 84 and the second grooves 82 may be formed in the side wall 76 adjacent to the back surface 77. Each of the first grooves 81 and the corresponding second surface 48 and second groove 82 may define a portion of the ink passage 80 extending from the front surface 70 to the back surface 77.

The first grooves 81 may be arranged in the side wall 76 side by side along the front surface 70. The first grooves 81 are respectively provided for the surface grooves 78. An end of each surface groove 78 may be connected to a corresponding one of the first grooves 81. The first groove 81 may have a substantially V-shaped horizontal cross section, and may be recessed from the side wall 76 in an extending direction of the surface groove 78. The first groove 81 may extend from the front surface 70 toward the back surface 77 substantially vertically, and reach a substantially center portion of the side wall 76, i.e., a boundary 87 between the first and third surfaces 83 and 85, and the second surface 84.

Figure 8:
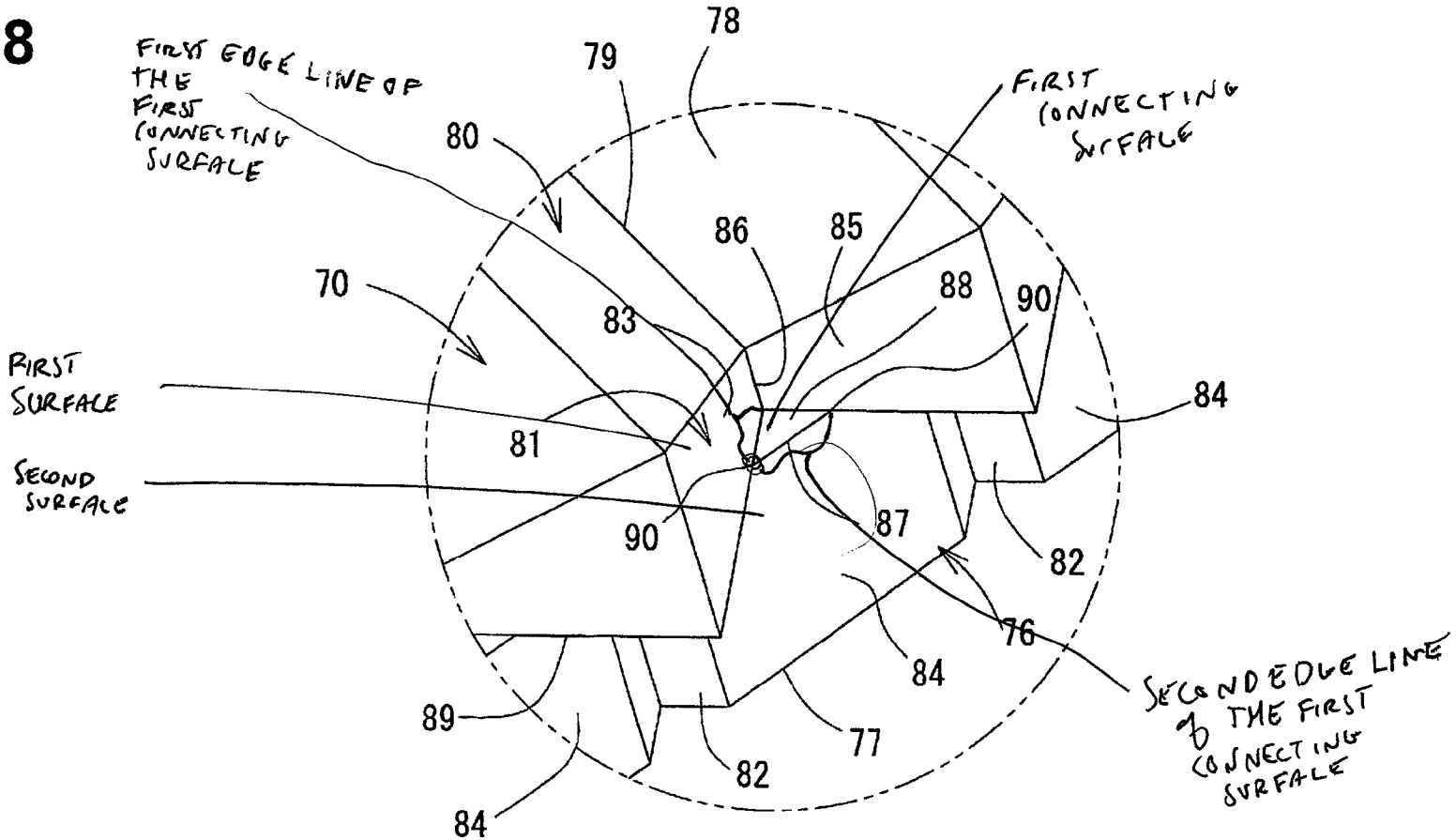
FIG. 8 is an enlarged, perspective view of a portion of the platen of FIG. 6 indicated by an arrow 52.
Figure 9A:
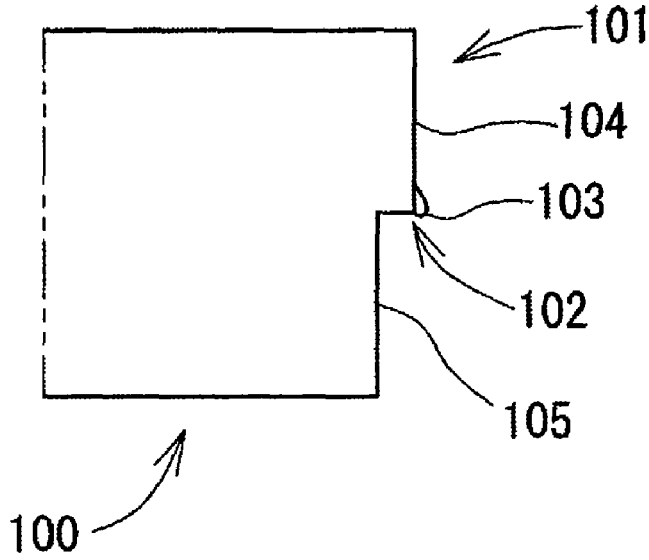
Fig.9A RELATED ART
FIGS. 9A and 9B are fragmental, front views of a side wall of a first known platen and a second known platen, respectively.
Figure 9B:
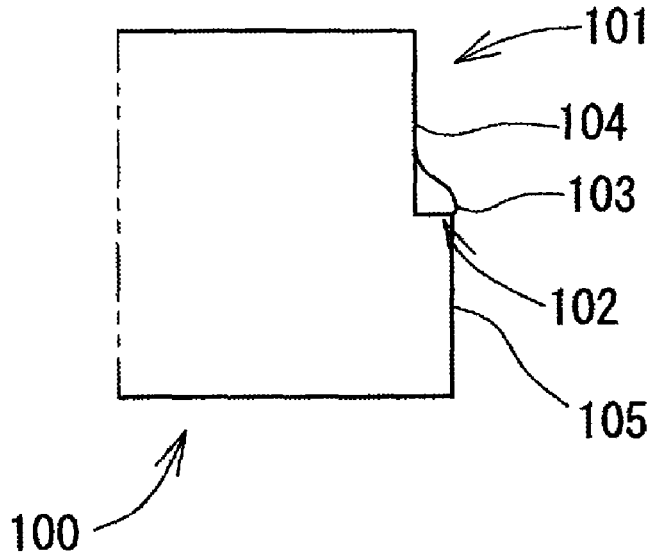
Fig.9B RELATED ART

Referring to FIG. 8, the first groove 81 may be defined by the first surface 83 and the third surface 85 which intersect each other to form a substantially V-shaped groove. The first and third surfaces 83 and 85 may be flat surfaces, and may be connected to respective surfaces of the substantially V-shaped surface groove 78. A deep portion 79 of the surface groove 78 may be connected to a deep portion 86 of the first groove 81, such that the ink may be guided from the surface groove 78 to the first groove 81 substantially horizontally along the respective surfaces of the surface groove 78, and substantially vertically along the first and third surfaces 83 and 85.

Referring to FIGS. 6 and 7, the second surfaces 84 may be provided in the side wall 76 adjacent to the back surface 77. Each of the second surfaces 84 may be a flat surface intersecting the first and third surfaces 83 and 85 of the corresponding first groove 81, and extending from a downstream edge of the first groove 81 to the back surface 77. The second surface 84 also may be a surface defining a portion of the ink passage 80. The ink flowing from the first and third surfaces 83 and 85 may be guided substantially vertically along the second surface 84. The first and third surfaces 83 and 85 may be located upstream and the second surface 84 may be located downstream in the ink flow direction.

Referring to FIG. 8, an upstream edge of the second surface 84 obliquely may intersect downstream edges of the first and third surfaces 83 and 85 (the intersection points are hereinafter referred to as ink guide portions 90). Thus, connecting surfaces and ink guide portions 90 may be formed at the boundary 87 between the first and third surfaces 83 and 85 and the second surface 84. As the connecting surfaces, a horizontal surface 88 may be formed adjacent to the deep portion 86 of the first groove 81, and two horizontal surfaces 89 may be formed adjacent to two portions of the first groove 81 that protrude beyond the second surface 84. The horizontal surface 88 may face an upstream side in the ink flow direction. The horizontal surfaces 89 may face a downstream side in the ink flow direction. The downstream edge of the first surface 83 may comprise an edge of the horizontal surface 88 and an edge of one of the horizontal surfaces 89. The upstream edge of the second surface 84 may comprise another edge of the horizontal surface 88 and another edge of the one of the horizontal surface 89. Other than at the ink guide portions 90, the second surface 84 may be indirectly connected to the first surface 83 via the horizontal surface 88 and one of the two horizontal surfaces 89, and may be indirectly connected to the third surface 85 via the horizontal surface 88 and the other of the two horizontal surfaces 89. One ink guide portion 90 may be formed at an intersection point between the first surface 83 and the second surface 84 and shared by the horizontal surface 88 and one of the two horizontal surfaces 89. Another ink guide portion 90 may be formed at an intersection point between the third surface 85 and the second surface 84 and shared by the horizontal surface 88 and the other of the two horizontal surfaces 89.

The boundary 87 may correspond to a parting surface when the platen 42 is made by injection molding. For example, when a two-plate mold is used, a portion comprising the front surface 70 of the platen 42 corresponds to a movable mold and a portion comprising the back surface 77 corresponds to a fixed mold. The movable mold and the fixed mold meet along a mating surface, i.e., a parting surface. Surfaces for forming the first and third surfaces 83 and 85, which are provided at the movable mold, intersect, on the parting surface, a surface for forming the second surface 84, which is provided at the fixed mold. The ink guide portions 90 may be formed at the intersection points on the border 87.

Referring to FIGS. 6 and 7, the second grooves 82 may be formed in the side wall 76 adjacent to the back surface 77. The second grooves 82 may extend straight from a corresponding one of the horizontal surfaces 89 formed at the boundary 87 to the back surface 77. The second groove 82 may be connected to the horizontal surface 89 at a portion other than the ink guide portions 90. The second groove 82 may have a substantially V-shaped horizontal cross section, and may be recessed in the same direction as that of the first groove 81. The second surfaces 84 may be arranged in the side wall 76 alternatively with the second grooves 82.

Next, the flow of ink in the ink passage 80 is described. The ink passage 80 may be defined by the surface groove 78, the first groove 81, the second surface 84, and the second groove 82, in that order from the front surface 70 of the platen 42. Ink adhering to the front surface 70 of the platen 42 may accumulate in the surface groove 78, and may begin flowing along the ink passage 80 by a gravitational force and/or a capillary force as a drive force acting on the ink. The drive force may be, for example, a capillary force at the surface groove 78, a capillary force and a gravitational force at the first and second grooves 81 and 82, or a gravitational force at the second surface 84, or any combination thereof. Nevertheless, the drive force does not have to be generated in the entire area of the ink passage 80.

Referring to FIG. 8, in the side wall 76, the first and third surfaces 83 and 85 defining the first groove 81 and the second surface 84 may be arranged adjacent to each other in the ink flow direction. The first and third surfaces 83 and 85 may be located upstream from the second surface 84 in the ink flow direction, to define a portion of the ink passage 80. In the side wall 76, the ink flows from the first and third surfaces 83 and 85 onto the second surface 84 by a drive force, such as a gravitational force. In the first groove 81, the ink may flow mainly along the deep portion 86 of the first groove 81. Because the horizontal surface 88, which faces upstream of the ink flow direction, is provided at the boundary 87, the ink flowing down along the deep portion 86 temporarily may remain on the horizontal surface 88. When the volume of the ink remaining on the horizontal surface 88 increases, the ink on the horizontal surface 88 reaches the ink guide portions 90. Because the first and third surfaces 83 and 85 directly may be connected, at the ink guide portions 90, to the second surface 84, the contact angle of the ink remains unchanged with respect to the first and third surfaces 83 and 85 and with respect to the second surface 84. Consequently, the surface tension acting on the ink remaining on the horizontal surface 88 may not increase, such that the ink may not require a larger drive force to move beyond the ink guide portion 90 than a drive force required when the ink moves on the horizontal surface 88. Accordingly, the ink on the horizontal surface 88 may move to the second surface 84 via the ink guide portions 90.

The ink may move to the second surface 84 from the ink guide portions 90, and move along the boundary 87 and along corner portions of the second surface 84 and the two horizontal surfaces 89 while receiving a gravitational force that drives the ink to move along the second surface 84. If the gravitational force acting on the ink is relatively large, the ink may move along the second surface 84 and reach the back surface 77. Even when the gravitational force acting on the ink is not relatively large, the ink may move along the corner portions of the second surface 84 and the horizontal surfaces 89, and reach the second grooves 82 on either side of the second surface 84. When the ink flows into the second grooves 82, a gravitational force and a capillary force may act on the ink, and thus, the ink may reach the back surface 77 along the second grooves 82. As described above, the ink adhering to the front surface 70 of the platen 42 may flow along the ink passage 80 to the back surface 77. Though not shown in the drawings, an ink absorber, such as felt, may be positioned adjacent to a downstream edge of the ink passage 80 to absorb the ink guided by the ink passage 80.

As described above, the first and third surfaces 83 and 85, and the second surface 84 partially define the ink passage 80, and the ink guide portions 90 may be provided at the boundary between the first and third surfaces 83 and 85, and the second surface 84, such that the first and third surfaces 83 and 85 directly are connected to the second surface 84 at the ink guide portions 90. Accordingly, the ink remaining on the horizontal surface 88 may move smoothly onto the second surface 84 via the ink guide portions 90. Consequently, ink droplets having not reached a recording sheet and adhering to the front surface 70 of the platen 42 may be guided through the ink passage 80 to the back surface 77, thereby preventing a subsequently fed recording sheet from being contaminated, or preventing an image recorded on the subsequently fed recording sheet from being deteriorated, or both.

In addition, because the boundary 87 corresponds to a parting surface when the platen 42 comprises a synthetic resin formed by injection molding, the ink passage 80 may be formed in the platen 42, such that the ink flows across an edge of the parting surface.

In particular, when the flat-plate platen 42 is formed by injection molding, an edge of a parting surface generally is located at the side wall 76. Thus, the ink passage 80 may be formed at the side wall 76, such that the ink flows across the edge of the parting surface through the ink guide portions 90 even when the positions of the ink guide portions 90 vary slightly due to a minute displacement of two molds from each other.

The first and third surfaces 83 and 85 define the first groove 81. A plurality of the first grooves 81 may be arranged side by side in the side wall 76. The second surface 84 may be formed as a flat surface intersecting the first and third surfaces 83 and 85 of a corresponding one of the first grooves 81. Accordingly, two ink guide portions 90 readily may be provided in each of the first grooves 81.

In addition, in the side wall 76, a plurality of the second grooves 82 may be formed to extend downstream from the boundary 87 in the ink flow direction. The ink flowing through the ink guide portions 90 may be guided smoothly to the back surface 77 along the second grooves 82.

In another embodiment, the third surface 85 may not be provided in the ink passage 80, and at least a single ink guide portion 90 may be provided at the second surface 84.

In another embodiment, the first surface 83 and the second surface 84 may be circumferential surfaces of cylinders having the same diameter, and the cylinders may be arranged adjacently in an axial direction while their axes are unaligned with each other.

In yet another embodiment, the ink passage 80 may be formed in a member other than the platen, e.g., to have an ink passage across a parting surface.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. An ink passage comprising:

a first surface comprising a downstream edge line, in an ink flow direction; and a second surface comprising an upstream edge line, in the ink flow direction;

wherein ink flows in the ink flow direction from the first surface to the second surface, and wherein a downstream edge line intersects the upstream edge line at no more than two intersection points.

2. The ink passage according to claim 1, further comprising a first connecting surface connecting each of the first surface and the second surface and facing upward and upstream of the ink flow direction, and a second connecting surface connecting each of the first surface and the second surface and facing downward and downstream of the ink flow direction, wherein the downstream edge line, in the ink flow direction, of the first surface comprises a first edge line of the first connecting surface and a first edge line of the second connecting surface, and the upstream edge line, in the ink flow direction, of the second surface comprises a second edge line of the first connecting surface and a second edge line of the second connecting surface.

3. A platen comprising:

a front surface configured to support thereon a recording medium; and a plurality of ink passages each comprising:

a first surface comprising a downstream edge line, in an ink flow direction; and a second surface comprising an upstream edge line, in the ink flow direction;

wherein ink flows in an ink flow direction from the first surface to the second surface, and wherein the downstream edge line intersects the upstream edge line at no more than two intersection points.

4. A platen comprising:

a front surface configured to support thereon a recording medium; and a plurality of ink passages each comprising:

a first surface comprising a downstream edge line, in an ink flow direction;

a second surface comprising an upstream edge line, in the ink flow direction;

a first connecting surface connecting each of the first surface and the second surface and facing upward and upstream of the ink flow direction; and a second connecting surface connecting each of the first surface and the second surface and facing downward and downstream of the ink flow direction;

wherein the downstream edge of the first surface comprises a first edge line of the first connecting surface and a first edge of the second connecting surface, and the upstream edge line of the second surface comprises a second edge line of the first connecting surface and a second edge line of the second connecting surface, wherein ink flows in the ink flow direction from the first surface to the second surface, and wherein the downstream edge line intersects the upstream edge line at an intersection point.

5. The platen according to claim 4, further comprising a side wall substantially orthogonal to the front surface, wherein the plurality of ink passages are formed in the side wall.

6. The platen according to claim 5, wherein each of the plurality of ink passages further comprises a first groove which is formed in the side wall and extends in the ink flow direction from the front surface of the platen to the first connecting surface, wherein at least a portion of the first groove is defined by the first surface.

7. The platen according to claim 6, wherein each of the plurality of ink passages further comprises a third surface, and the first surface and the third surface define the first groove, wherein the second surface is flat and intersects each of the first surface and the third surface.

8. The platen according to claim 6, wherein each of the plurality of ink passages further comprises a second groove which is formed in the side wall and extends from the second connecting surface toward a downstream side of the platen in the ink flow direction.

9. The platen according to claim 5, further comprising a back surface opposite the front surface, wherein the plurality of ink passages are arranged side by side in the side wall, and each of the plurality of ink passages extend from the front surface to the back surface.

10. An inkjet recording device comprising:

a recording head configured to eject ink; and a platen comprising:

a front surface configured to support thereon a recording medium; and a plurality of ink passages each comprising:

a first surface comprising a downstream edge line, in an ink flow direction; and a second surface comprising an upstream edge line, in the ink flow direction;

wherein ink flows in the ink flow direction from the first surface to the second surface, and wherein the downstream edge line intersects the upstream edge line at no more than two intersection points.

11. The inkjet recording device according to claim 10, wherein each of the plurality of ink passages further comprises a first connection surface connecting each of the first surface and the second surface and facing upward and upstream of the ink flow direction, and a second connecting surface connecting each of the first surface and the second surface and facing downward and downstream for the ink flow direction, and wherein the downstream edge line, in the ink flow direction, of the first surface comprises a first edge line of the first connecting surface and a first edge line of the second connecting surface, and the upstream edge line, in the ink flow direction, of the second surface comprises a second edge line of the first connecting surface and a second edge line of the second connecting surface.

12. The inkjet recording device according to claim 10, wherein the downstream edge line intersects the upstream edge line at only a single intersection point.

13. The ink passage according to claim 1, wherein the downstream edge line intersects the upstream edge line at only a single intersection point.

* * * * *